United States Patent [19]

Rohr

[11] 3,958,608

[45] May 25, 1976

[54] SHEDDING DRIVE ARRANGEMENT

[75] Inventor: Willy Rohr, Hinwil, Switzerland

[73] Assignee: Ruti Machinery Works Ltd., Ruti (Zurich), Switzerland

[22] Filed: Mar. 26, 1974

[21] Appl. No.: 454,965

[30] Foreign Application Priority Data

Mar. 30, 1973 Switzerland ..... 4583/73

[52] U.S. Cl. ..... 139/84; 139/66 R; 139/449

[51] Int. Cl.[2] ..... D03D 13/00; D03D 1/00

[58] Field of Search ..... 139/66 R, 66 A, 55, 139/82, 84, 88, 79, 67–77, 122 R, 123, 127 R, 122

[56] References Cited

UNITED STATES PATENTS

| | | | |
|---|---|---|---|
| 204,466 | 6/1878 | Walker | 139/84 |
| 2,580,994 | 1/1952 | Budzyna et al. | 139/79 |
| 3,394,739 | 7/1968 | Crenshaw et al. | 139/127 R |
| 3,759,298 | 9/1973 | Kaufmann | 139/82 |

FOREIGN PATENTS OR APPLICATIONS

| | | | |
|---|---|---|---|
| 106,755 | 9/1924 | Switzerland | 139/82 |
| 20,814 | 1896 | United Kingdom | 139/84 |
| 713,185 | 8/1954 | United Kingdom | 139/84 |
| 7,037 | 1912 | United Kingdom | 139/84 |

*Primary Examiner*—James Kee Chi
*Attorney, Agent, or Firm*—Donald D. Denton

[57] ABSTRACT

The present invention relates to a shedding drive arrangement for a loom, with a dobby driving the upper and lower sheds symmetrically and with a coupling arrangement coupling the rockers of the dobby with the weaving shafts to produce a non-symmetrical shed movement. By "rockers" or jack levers there are generally understood elements which transmit the driving movement produced by the dobby and available at its output side.

5 Claims, 4 Drawing Figures

SHEDDING DRIVE ARRANGEMENT

BACKGROUND OF THE INVENTION

When weaving on conventional weaving machines using weaving shuttles, the dobbies operate in such a manner that the shafts are continuously in motion and the upwardly and downwardly moved shafts carry out a so-called symmetrical shed movement. In this shed movement, the upper and lower sheds move symmetrically in relation to the central position of the warp threads, that is to say, move towards and away from one another by equal distances at each instant of time.

In cases where non-symmetrical shed movement is required, hitherto weaving shafts driven by eccentric discs have been used, the desired weaving shaft movements being formed by suitable shaping of the eccentric outline. When using programme-controled dobbies, for example of the Hattersley type, wherein plates or hooks operated by means of lifting blades are used, it is per se not possible to form a non-symmetrical weaving shaft or shed movement.

An arrangement which could be considered would be to give the forwardly and rearwardly moved lifting blades non-identical speeds. But this kind of operation involves difficulties in the case of dobby apparatus known at the present day. Per se it is also possible to make the lifting blades come into action later when the shafts are raised than when the shafts are lowered, for example. But this has the result that those shafts which are to remain in the raised position begin to descend owing to the earlier commencement of the down movement and remain stationary again only when the raising of the lowered shafts has begun, to move entirely into the raised position again only at the end of shed forming. This method of operation results in unnecessary movements and unsteadiness at the shedding and rockers, which is disadvantageous. Also, increased wear on the dobby occurs. A further solution which might be considered would be to make the duration of the open shed position as long as possible. Since this reduces the time available for shed changing, this requires extremely quick shed changing and this in turn involves the disadvantage of over-stressing the moving parts of the dobby.

The closest prior art known to the applicant in connection with the invention presented in this application for Letters Patent is in:

U.S. Pat. No. 2,924,247 and
U.S. Pat. No. 2,955,619.

SUMMARY

According to the present invention, a shaft drive for a non-symmetrical weaving shaft or heald frame movement using any dobby producing a symmetrical shaft movement in use at the present day is to be provided wherein the aforesaid disadvantages are obviated.

The present invention is characterized in that a coupling arrangement comprises first and second arms, that each rocker or jack lever has a first arm and a second arm associated therewith, that the second arm is pivotable at one end about a stationary pivot and with its other end is secured to be pivotable by means of a second pivot to one end of the first arm, and that the other end of the first arm can be given a reciprocating movement by means of the associated rocker, which is effected over a predetermined distance and which at the first arm produces a force directed in the longitudinal direction thereof and whereby a movement of one end of the first arm is brought about which is unsymmetrical in relation to the position of this last-mentioned end in which the plane defined by the axis of the second pivot and by the longitudinal direction of the first arm is in a tangential situation on the locus of the last-mentioned axis relatively to the stationary pivot.

In weaving machines wherein gripper elements secured to driving bands are provided for introducing the weft threads into a shed, there is a risk that the gripper elements secured to the ends of the bands on issuing from the shed will be slightly raised by the warp threads of the lower shed, since in this working phase the shed is already at the closing stage. Thus it is particularly important for such machines that the warp threads of the lower shed half begin to rise only when the gripper elements issue from the shed or have already issued, and the upper warp threads may have already carried out a considerable portion of their shed movement. It is even desirable that the upper warp threads should have already been substantially lowered in this working phase, since in this way an additional guiding of the gripper elements is obtained. An important field of use for the present invention is therefore in weaving machines using gripper elements carried by bands.

BRIEF DESCRIPTION OF THE DRAWINGS

The invention will be explained in detail with the help of a constructional example and the drawings, in which.

DESCRIPTION OF PREFERRED EMBODIMENT

Figure 1:
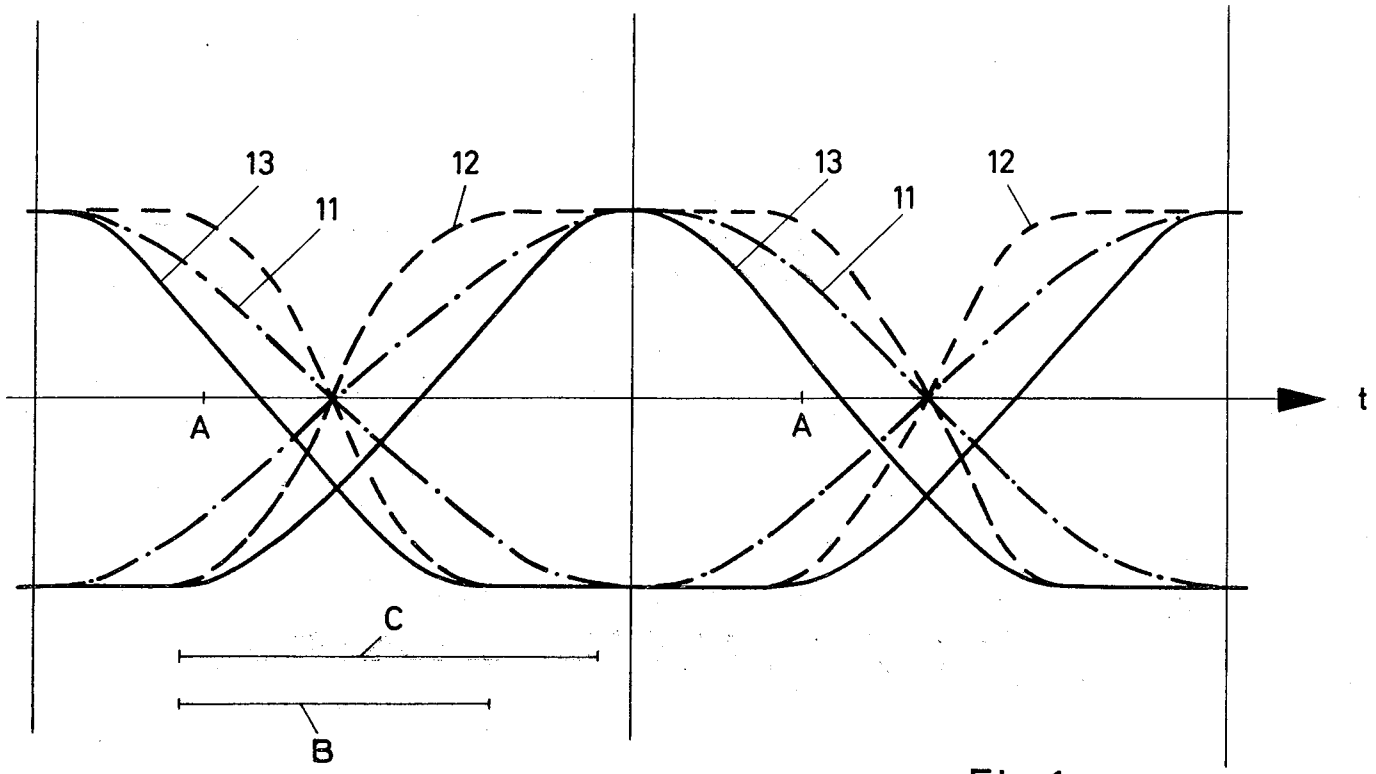
FIG. 1 shows in chart form various kinds of movement of the shed.

FIG. 1 illustrates three various kinds of movement of weaving sheds as a function of time $t$, which is plotted on the $x$-axis. The curves 11 shown in dot-dash lines show the movement of the two halves of the shed as produced by a conventional dobby, for example working with a shuttle type of weaving machine.

If in a weaving machine with weft thread gripper elements secured to bands the gripper elements issue for example at the instant A, it will be apparent that a lifting of the gripper element heads secured to the bands can be brought about in the case of a shed movement as shown at the curves 11 by the warp threads of the lower shed half. But this kind of operation is unacceptable. A possible remedy by increasing the open shed position, as shown by the curves 12 shown in broken lines, would per se be helpful but would involve the disadvantage already mentioned of extremely rapid shed changing.

According to the present invention a weaving shaft movement in accordance with the curves 13 is proposed. FIG. 1 shows that for a shed change in accordance with curves 12 an interval of time B is available, and for a shed change as shown by the curves 13 an interval of time C is available, that is to say a much longer time. The $x$-axis for the time $t$ can also be taken in FIG. 1 to represent the plane which, when the shed is fully opened, is given by the bisector plane situated between the upper shed and lower shed. It is apparent that the shed movements shown in curves 11 and 12 are symmetrical in relation to the bisector plane just defined and that the shed movement indicated by the full-line curve 13 is unsymmetrical in relation to the said plane.

Figure 2:
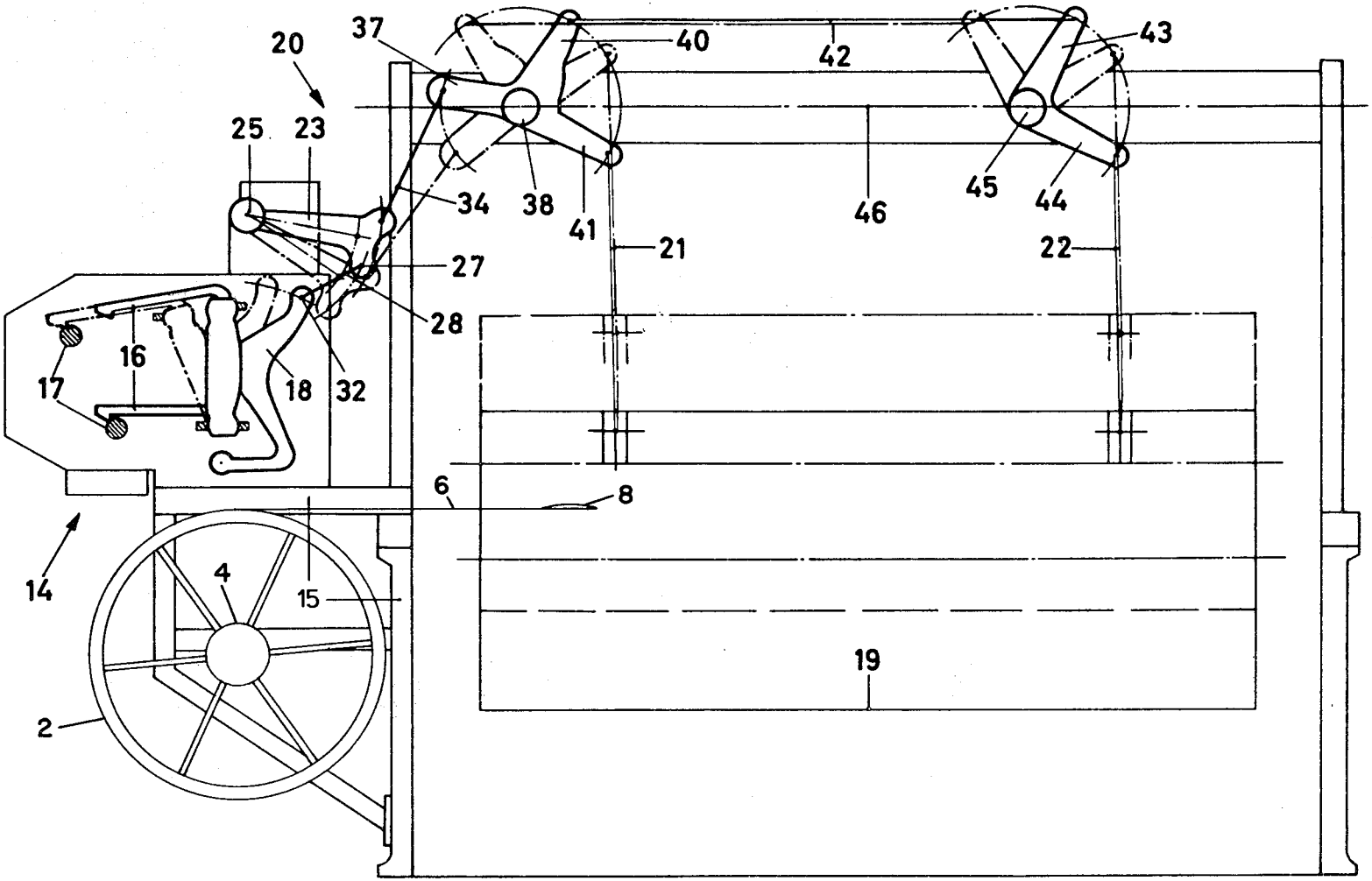
FIG. 2 shows a vertical view of a weaving shaft drive arrangement in accordance with the invention.

In the constructional example shown in FIG. 2, a dobby 14 is attached to the frame 15 of a weaving machine. For purposes of illustration, hooks 16 and lifting blades 17 are shown which are used for operating rockers 18. The movements of the rockers 18 are transmitted by a coupling arrangement 20 and connecting elements 21, 22 to shafts 19, the latter carrying out an upward and downward movement of the shafts.

Figure 3:
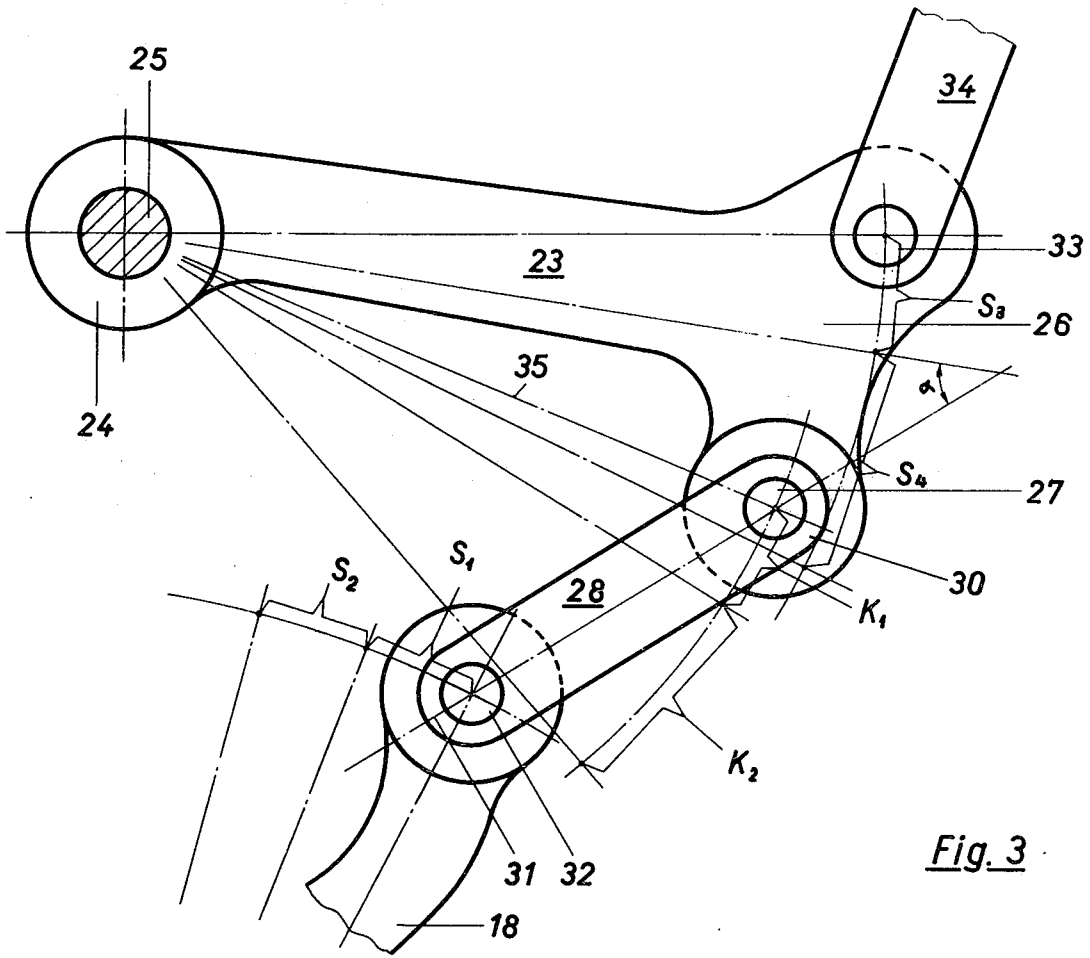
FIGS. 3 and 4 show partial views of parts of the shaft drive arrangement, with various positions when in operation indicated by broken line and in which these parts are shown on a larger scale in order to make the method of operation clearer.

That part of the coupling arrangement 20 which adjoins the dobby 14 is shown on a larger scale and in more detail in FIG. 3. A first arm 28 and a second arm 23 are provided. The second arm 23 is pivotable at one end 24 of the said arm about a pivot 25 which is attached to the weaving machine. Situated at its other end 26 is a further pivot 27 to which the first arm 28 is pivotably connected at its end 30. The other end 31 of the first arm 28 is connected to the rocker 18 by means of the further pivot 32. A third arm 34 is secured at pivot 33 to second arm 23 at end 26. With each rocker 18 of the dobby 14 there are coupled respective first and second arms 28, 23 and third arm 34 by way of the appropriate pivots 32, 27, 33, respectively.

When, during operation of the dobby 14, the rocker 18 is swung towards the left as illustrated in FIG. 3, the first arm 28 is also drawn towards the left. The center of the pivot 32 moves over the distances S1, S2. As a result, the second arm 23 pivots about the fixed pivot 25. In so doing, the center of the pivot 27 describes for example the arc K1, K2. The movement of the end 26 is transmitted by the arm 34.

It follows from geometric considerations that the arc K1 corresponding to the distance S1 is smaller than the arc K2 corresponding to the distance S2, which is equal to the distance S1. The ratio of the corresponding distances K to S depends on the angle $\alpha$ which the centerlines of arms 23 and 28 form with one another. The more this angle $\alpha$ approximates to the value zero, the greater does the ratio of distances K to S become. Conversely, when the arm 28 moves about the position in which it is at right angles to the line joining the centers of the pivots 25, 27, a movement K of only very small extent corresponds to a movement S.

It will be readily apparent that a correct operation does not occur if the force exerted by the rocker 18 on the first arm 28 were directed permanently at right angles to the longitudinal direction of the said arm, since in this case no force would act in the longitudinal direction of the arm 28 and the arm 28 would only rotate about the pivot 27; thus a force directed in the longitudinal direction of the arm 28 must be present.

Figure 4:
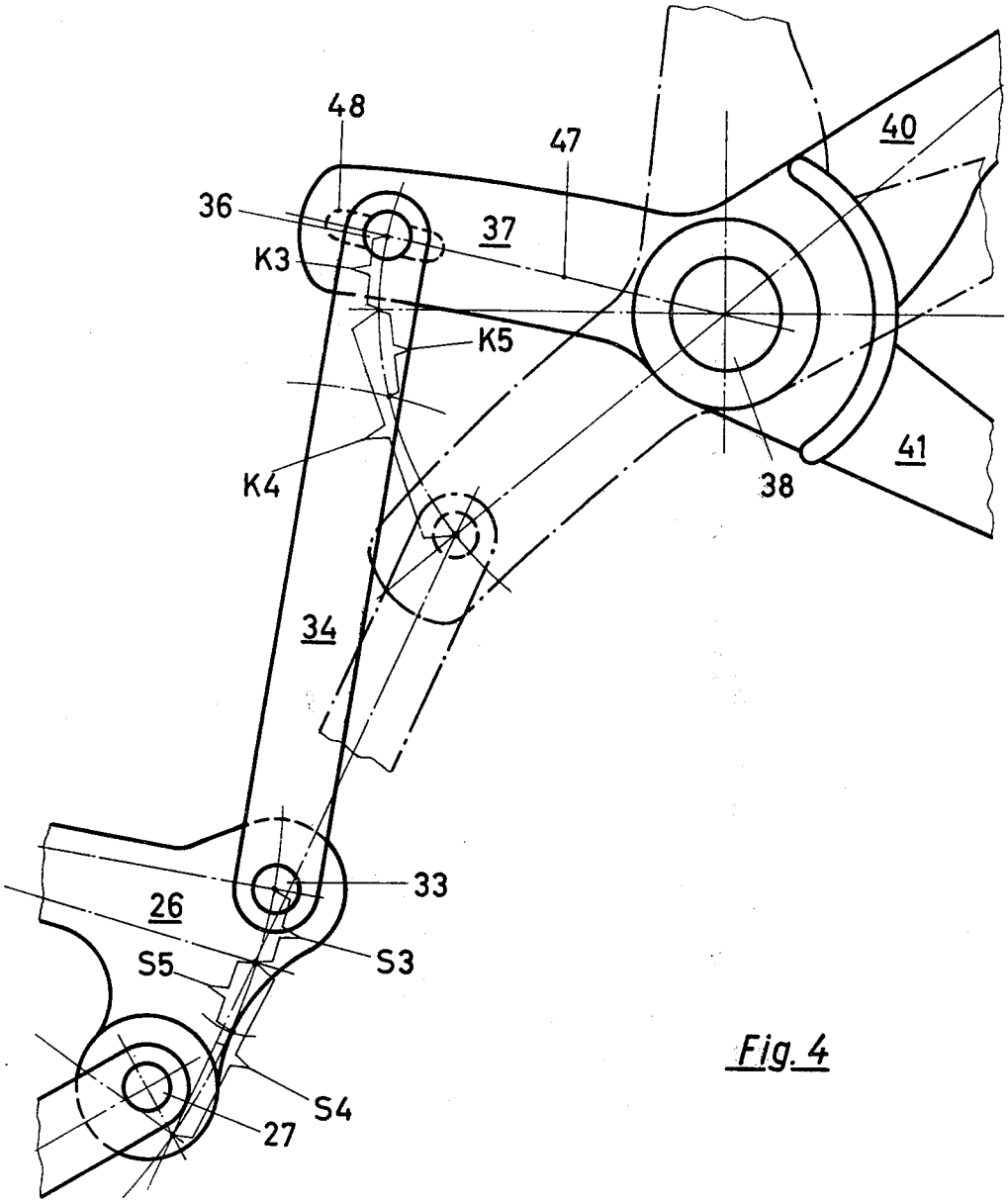

As FIG. 4 shows, the arm 34 is connected by means of a pivot bearing 36 to a fourth arm 37. The latter is adapted to rotate about the stationary pivot 38. Fifth and sixth arms 40 and 41, respectively, are connected fast with the fourth arm 37. As shown in FIG. 2, the sixth arm 41 is connected by way of the connecting element 21 to one side of the shaft 19. Pivotably connected to the fifth arm 40 is a rod 42 which extends as far as a two-arm lever 43, 44, having angularly disposed arms 43, 44 which are mounted to be capable of rotating in unison about pivot 45. From the arm 44 of said two-arm lever, a connecting element 22 also leads to the shaft 19, and arm 43 is connected by rod 42 to fifth arm 40. It is noted that the angular positioning of the arms of the two-arm lever is the same as that of the fifth and sixth arms. The arms 34, 37 form a crank arrangement similar to the crank arrangement with the arms 23, 28, the first arm 28 corresponding to the arm 34 and the second arm 23 to the arm 37. On movement of the third arm 34 in the second arrangement in a downward direction, the predetermined distances S3, S4 travelled by the axis of the pivot 33 correspond to the distances K3, K4 of the axis of the pivot 36, the distance ratio K3/S3 at the beginning of movement being smaller than the distance ratio K4/S4 at the end of movement. Correspondingly, the pivoting angle of the fourth arm 37 in the second arrangement in relation to a given distance, for example a given travel of the pivot 33, is smaller at the beginning of the movement than at the end of the movement.

It is also possible to assume that the pivot 33 moves over equal-length distances S3 and S5. The travels K3 and K5 of the axis of the pivot 36 correspond to these distances. It will be apparent that the ratio of the distances K3 and S3 is smaller than the ratio of the distances K5 to S5. Thus it is also apparent again that when travelling over equal-length distances S3 and S5, the distance K3 corresponding to the distance S3 is relatively shorter than the distance K5 corresponding to the distance S5.

In order to make the visual illustration as clear as possible, FIGS. 2 and 4 show the two possible end positions of the rocker 18 and the other parts which are also moved, one end position being in full lines and the other in broken lines.

When, during operation, the rocker 18 of the dobby 14 moves from the full-line position into the broken-line position, the axis of the pivot 32 moves over the distance S1 and then over the distance S2 which is of the same in length. As a result of the coupling by way of the arm 28, the axis of the pivot 27 at this time moves first of all over the distance K1 and then over the distance K2. Whilst the axis of 32 travels over the distance S1, the axis of pivot 27 travels over the distance K1 and whilst the axis of pivot 32 travels over the distance S2, the axis of the pivot 27 travels over the distance K2. The distances S1 and S2 are equal in length, but the distance K2 is longer than K1. At the same time the axis of the pivot 36 moves over the distances K3 and K4, and the distance ratio K4 and K3 is increased again in relation to the distance ratio K2 and K1.

Thus there is obtained a movemment of the weaving shaft 19 which, as the curve 13 in FIG. 1 shows, first of all takes place slowly as the shaft 19 moves upwards and then takes place more quickly. Conversely, the downward movement of the shaft 19 is rapid at first and becomes slow at the end. The movement of the rocker 18, which with direct coupling with the shaft 19 results in a symmetrical movement of the said shaft, is converted by the coupling arrangement 20 into an unsymmetrical movement of the shaft 19.

The arrangement of the illustrated constructional example can be made such that the desired movement of the shaft 19 is produced substantially by the coupling arrangement shown in FIG. 3 and the coupling arrangement according to FIG. 4 is used for obtaining correction or for achieving a desired unsymmetrical movement of shaft 19 which would follow the form of the curve 13 shown in FIG. 1.

Referring again to FIG. 2, it will be apparent that the movement of the arm 41 does not result in any distorting of the longitudinal movement of the shaft 19, since the arm 41 and also the arm 44 pivot through the same angle in relation to the straight line 46. It is per se possible to obtain further variations in the pattern of movement of the shaft 19, that is to say the curve 13, if the arms 41 and 40 are arranged in relation to the arm 37 in such a manner that a pivoting movement takes place through different angles in relation to the straight line 46. But this would involve the disadvantage that the elements 21 and 22 in both end positions of the said elements would form different angles in relation to the horizontal shaft frames of the shaft 19.

It will presumably be readily apparent that for example the coupling arrangement shown in FIG. 4 must not carry out a movement which is symmetrical to the straight line 47, since no unsymmetry would be produced with such a movement. The straight line 47 is characterized in that it is situated at right angles to the plane defined by the two axes of the pivots 33 and 36 or on the plane defined by the axis of the pivot 36 and by the longitudinal direction of the arm 34, that is to say, this plane in the illustrated position of the arm 34, is tangential on the locus of the axis of the pivot 36 relatively to the stationary pivot 38.

It is also possible to make the variations of the movement transmitted by the rocker 18 to the arms 40, 41 adjustable. This can be achieved for example by making the length of the arm 37 variable. This kind of arrangement can be obtained for example by securing the pivot 36 at optional points over the length of a slot 48 (FIG. 4). This kind of adjustable securing arrangement can be provided at other regions than on the arm 37, for example at the arm 23.

It will be appreciated that the shedding drive arrangement may have gripping elements secured to drive bands or tapes for introducing weft threads into a shed in such a manner that the intersection of the longitudinal centerline of the first and second arms 28 and 23, respectively, during operation of the arrangement, continuously forms an acute angle and movement of the arms to close this acute angle moves the heald frame into its upper shed position.

FIG. 2 of the drawings shows a band wheel 2 which turns about an axis 4 carrying a tape or band 6 having a gripper element 8 attached to one end thereof for effecting weft yarn insertion in the shed of the loom. The tape 6 and gripper element 8 are synchronized with the coupling arrangement 20 so that the weft thread insertion function is carried out during the weaving process.

It will be appreciated that various changes and modifications may be made within the skill of the art without departing from the spirit and scope of the invention illustrated and described herein.

What is claimed is:

1. A shedding drive arrangement having a dobby driving the upper and lower sheds symmetrically and with a coupling arrangement, coupling jack levers of the dobby with the heald frames, the coupling arrangement comprising first and second arms, each jack lever having a first arm and a second arm operatively connected with it, the second arm being pivotably mounted at one end about a stationary pivot and at its other end secured by means of a second pivot in pivotable manner to one end of the first arm, the other end of said first arm being pivoted to and driven by means of said associated jack lever, said jack lever, when in motion, producing a reciprocating movement which is carried out over a predetermined distance, said movement producing at the first arm a force directed in the longitudinal direction of the said first arm and by which there is brought about a movement of the said end of the first arm that is connected to said second arm, which is unsymmetrical in relation to that position of the said one end of the first arm in which the plane defined by the axis of the second pivot and by the longitudinal direction of the first arm is in a tangential situation at the locus of the axis of the second pivot relative to the said stationary pivot.

2. The shedding drive arrangement according to claim 1 in which the freely movable end of the pivoted second arm, which is connected to said first arm, is in addition operatively connected by way of a third pivot to a third arm, and this third arm transmits forces by movement of said rocker to move the weaving shaft.

3. The shedding drive arrangement according to claim 2 in which a fourth arm is pivotable at one end about a stationary pivot with its other end pivotable by a fourth pivot to one end of said third arm, and the other end of said third arm pivotable by said second arm so that when the second arm produces a force directed in the longitudinal direction of the third arm, the said force brings about a movement of one end of the third arm which is unsymmetrical in relation to that position of the said end in which the plane defined by the axis of the fourth pivot and by the longitudinal direction of the third arm is in a tangential situation at the locus of the last-mentioned axis relatively to the further stationary pivot.

4. The shedding drive arrangement according to claim 3 in which the pivot connecting the ends of said third and fourth arms together is adapted to be pivotably secured on at least one of the arms at various positions along a range in order to make the effective length of said fourth arm adjustable.

5. The shedding drive arrangement according to claim 1 wherein gripping elements secured to driving tapes are used for introducing weft threads into a shed, the intersection of the longitudinal centerline of said first and second arms during operation continuously forms an acute angle, and movement of said arms to close this acute angle moves the weaving shaft into its upper shed position.

* * * * *